US009118991B2

(12) United States Patent
Nystrom et al.

(10) Patent No.: US 9,118,991 B2
(45) Date of Patent: Aug. 25, 2015

(54) REDUCING HEAD-RELATED TRANSFER FUNCTION DATA VOLUME

(75) Inventors: Martin Nystrom, Horja (SE); Sead Smailagic, Helsingborg (SE)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 349 days.

(21) Appl. No.: 13/823,977

(22) PCT Filed: Jun. 9, 2011

(86) PCT No.: PCT/IB2011/052521

§ 371 (c)(1),
(2), (4) Date: Mar. 15, 2013

(87) PCT Pub. No.: WO2012/168765

PCT Pub. Date: Dec. 13, 2012

(65) Prior Publication Data

US 2013/0170679 A1 Jul. 4, 2013

(51) Int. Cl.

| | |
|---|---|
| ***H04R 5/00*** | (2006.01) |
| ***H04R 5/033*** | (2006.01) |
| ***H04S 1/00*** | (2006.01) |

(52) U.S. Cl.

CPC ..... *H04R 5/033* (2013.01); *H04S 1/005* (2013.01); *H04S 2420/01* (2013.01)

(58) Field of Classification Search

None

See application file for complete search history.

(56) References Cited

U.S. PATENT DOCUMENTS

| | | | | |
|---|---|---|---|---|
| 3,962,543 | A | 6/1976 | Blauert et al. | |
| 5,495,534 | A | 2/1996 | Inanaga et al. | |
| 5,982,903 | A * | 11/1999 | Kinoshita et al. | 381/18 |
| 7,369,668 | B1 * | 5/2008 | Huopaniemi et al. | 381/310 |
| 2001/0040968 | A1 * | 11/2001 | Mukojima | 381/17 |
| 2005/0190925 | A1 * | 9/2005 | Miura et al. | 381/17 |
| 2008/0253578 | A1 | 10/2008 | Breebaart et al. | |
| 2010/0080396 | A1 | 4/2010 | Aoyagi | |
| 2011/0135098 | A1 * | 6/2011 | Kuhr et al. | 381/17 |

OTHER PUBLICATIONS

International Search Report dated Mar. 14, 2012 issued in corresponding PCT application No. PCT/IB2011/052521, 16 pages.

Liang Chen et al: "Head-Related Impulse Response Interpolation in Virtual Sound System," Natural Computation, 2008. ICNC '08. Fourth International Conference on, IEEE, Piscataway, NJ, USA, Oct. 18, 2008, pp. 162-166.

(Continued)

*Primary Examiner* — Wayne Young

*Assistant Examiner* — Mark Fischer

(74) *Attorney, Agent, or Firm* — Snyder, Clark, Lesch & Chung, LLP

(57) ABSTRACT

A device may store a subset of a plurality of head-related transfer functions (HRTFs) for emulating stereo sound from a source in three-dimensional (3D) space, each of the HRTFs corresponding to a direction from which the stereo sound is perceived to arrive, by a user hearing the stereo sound. The device may also obtain a first direction from which first stereo sound is perceived to arrive, by the user and determine whether the subset of the plurality of HRTFs includes a first HRTF corresponding to the first direction, wherein the plurality of HRTFs include the first HRTF. Further, the device may select two HRTFs in the subset of the HRTFs, wherein directions that are associated with the two HRTFs are closer to the first direction than directions of other HRTFs in the subset of the HRTFs.

20 Claims, 12 Drawing Sheets

(56) References Cited

OTHER PUBLICATIONS

Nishino T et al: "Interpolating head related transfer functions in the median plane," Applications of Signal Processing to Audio and Acoustics, 1999 IEEE Workshop on New Paltz, NY, USA, Oct. 17-20, 1999, pp. 167-170.

International Search Report dated Dec. 27, 2013 issued in corresponding PCT application No. PCT/IB2011/052521, 13 pages.

* cited by examiner

REDUCING HEAD-RELATED TRANSFER FUNCTION DATA VOLUME

BACKGROUND

In three-dimensional (3D) audio technology, a pair of speakers (e.g., earphones, in-ear speakers, in-concha speakers, etc.) may realistically emulate sound sources that are located in different places. A digital signal processor, digital-to-analog converter, amplifier, and/or other types of devices may be used to drive each of the speakers independently from one another, to produce aural stereo effects.

SUMMARY

A system may include a device. The device may include a memory configured to store a subset of a plurality of head-related transfer functions (HRTFs) for emulating stereo sound from a source in three-dimensional (3D) space, each of the HRTFs corresponding to a direction, as perceived by a user, of the stereo sound. The device may also include an output interface for receiving audio information from a processor and outputting signals corresponding to the audio information. The device may also include the processor. The processor may be configured to obtain a direction, to be perceived by the user hearing an emulated stereo sound, for generating the emulated stereo sound and to determine whether the subset of the HRTFs includes a first HRTF corresponding to the direction, wherein the plurality of HRTFs includes the first HRTF. The processor may use two HRTFs in the subset of the HRTFs to obtain an estimated HRTF of the first HRTF when the processor determines that the subset of the HRTFs does not include the first HRTF. Furthermore, the processor may apply the estimated HRTF to an audio signal to generate the audio information.

Additionally, the system may further include earphones configured to receive the signals and to generate right-ear sound and left-ear sound.

Additionally, when the earphones receive the signals, the earphones may receive the signals over a wireless communication link.

Additionally, the earphones may include one of headphones, ear buds, in-ear speakers, or in-concha speakers.

Additionally, the device may include one of a tablet computer, a mobile telephone, a personal digital assistant, or a gaming console.

Additionally, the system may further include a remote device configured to generate the subset of the HRTFs.

Additionally, the plurality of HRTFs may include HRTFs that are mirror images of the subset of the plurality of HRTFs.

Additionally, when the processor uses the two HRTFs in the subset of the HRTFs to obtain the estimated HRTF, the processor may be configured to select two directions that are closest to the direction of the stereo sound and whose two corresponding HRTFs are included in the subset of the HRTFs stored in the memory/ The processor may be further configured to retrieve the two HRTFs from the memory and form a linear combination of the two retrieved HRTFs to obtain the estimated HRTF.

Additionally, wherein when the processor forms the linear combination of the two retrieved HRTFs, the processor may be further configured to obtain a first coefficient and a second coefficient, obtain a first product of the first coefficient and one of the two retrieved HRTFs, obtain a second product of the second coefficient and other of the two retrieved HRTFs; and add the first product to the second product to obtain the estimated HRTF.

Additionally, when the processor determines that the subset of the HRTFs includes the first HRTF, the processor may be further configured to retrieve the first HRTF from the memory.

According to another aspect, a method may include storing a subset of a plurality of head-related transfer functions (HRTFs) for emulating stereo sound from a source in three-dimensional (3D) space, each of the HRTFs corresponding to a direction from which the stereo sound is perceived to arrive, by a user hearing the stereo sound. The method may also include obtaining a first direction from which first stereo sound is to be perceived to arrive, by the user, and determining whether the subset of the plurality of HRTFs includes a first HRTF corresponding to the first direction, wherein the plurality of HRTFs include the first HRTF. The method may further include selecting a first and second stored HRTFs in the subset of the HRTFs, wherein directions that are associated with the first and second stored HRTFs are closer to the first direction than directions of other HRTFs in the subset of the HRTFs. The method may further include applying the first stored HRTF to an audio signal to obtain a first intermediate signal, applying the second stored HRTF to the audio signal to obtain a second intermediate signal, and generating output signals for headphones based on the first intermediate signal and the second intermediate signal.

Additionally, the method may further include sending the output signals for the headphones over wires connected to the headphones.

Additionally, the method may further include receiving the subset of the plurality of HRTFs from a remote device.

Additionally, the plurality of HRTFs may include HRTFs that are mirror images of the subset of the plurality of HRTFs.

Additionally, the generating the output signal may include calculating a linear combination of the first intermediate signal and the second intermediate signal.

Additionally, the method may further include retrieving the first HRTF from the memory when the subset of the HRTFs includes the first HRTF.

Additionally, the method may further include obtaining a distance from which the first stereo sound is to be perceived to arrive by the user.

Additionally, the method may further include determining whether a location of the sound source, as determined by the first direction and the distance, is within a region, in the 3D space, in which the first HRTF cannot be estimated by one or more HRTFs in the subset of the HRTFs, and retrieving an HRTF corresponding to the location of the sound source when the location of the sound source is determined to be within the region and applying the retrieved HRTF to the audio signal to generate the output signals for driving the headphones.

According to yet another aspect, a computer-readable medium may include computer-readable instruction for configuring one or more processors. The one or more processors may be configured to store a subset of a plurality of head-related transfer functions (HRTFs) for emulating stereo sound from a source in three-dimensional (3D) space, each of the HRTFs corresponding to a distance and direction from which the stereo sound is perceived to arrive, by a user hearing the stereo sound. The one or more processors may also be configured to obtain a first direction and a first distance from which first stereo sound is to be perceived to arrive, by the user. The one or more processors may be further configured o determine whether the subset of the plurality of HRTFs includes a first HRTF corresponding to the first direction and the first distance, wherein the plurality of HRTFs include the first HRTF. The one or more processors may also be configured to select first two HRTFs, in the subset of the HRTFs, corresponding to one distance, and use the first two HRTFs in the subset of the HRTFs to obtain a first estimated HRTF when the subset of the HRTFs does not include the first HRTF. The one or more processors may be further configured to select second two HRTFs, in the subset of the HRTFs, corresponding to another distance. The one or more processors may still be further configured to use the second two HRTFs in the subset of the HRTFs to obtain a second estimated HRTF when the subset of the HRTFs does not include the first HRTF, and determine a third estimated HRTF of the first HRTF based on the first estimated HRTF and the second estimated HRTF. The one or more processors may also be configured apply the third estimated HRTF to an audio signal to generate output signals for driving headphones, wherein the first distance is between the one distance and the other distance.

Additionally, the computer-readable medium may further include computer-executable instructions for further configuring the processor to send the output signals for the headphones over a wireless communication link.

BRIEF DESCRIPTION OF THE DRAWINGS

The accompanying drawings, which are incorporated in and constitute part of this specification, illustrate one or more embodiments described herein and, together with the description, explain the embodiments. In the drawings.

DETAILED DESCRIPTION

The following detailed description refers to the accompanying drawings. The same reference numbers in different drawings may identify the same or similar elements. As used herein, the term "body part" may include one or more body parts (e.g, a hand includes fingers).

In the following, a system may drive multiple speakers in accordance with a head-related transfer function (HRTF) to generate realistic stereo sound. The HRTF may be determined by intensity panning pre-computed HRTFs. The intensity panning allows fewer HRTFs to be pre-computed for the system.

Figure 1A:
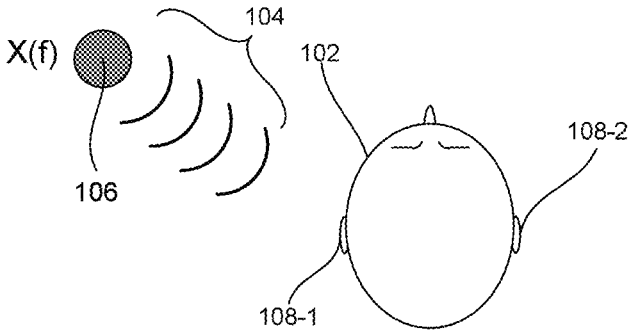
FIGS. 1A, 1B, and 1C illustrate concepts that are described herein.
Figure 1B:
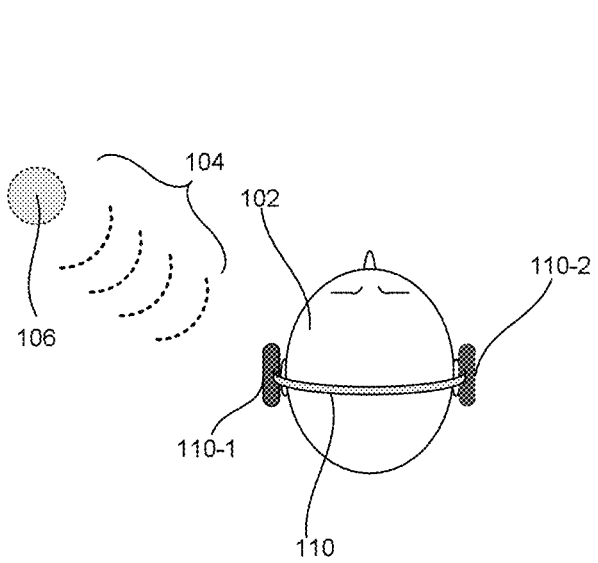
Figure 1B:
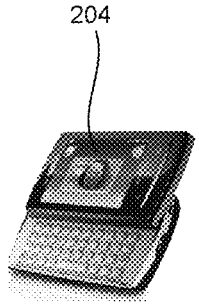
Figure 1C:
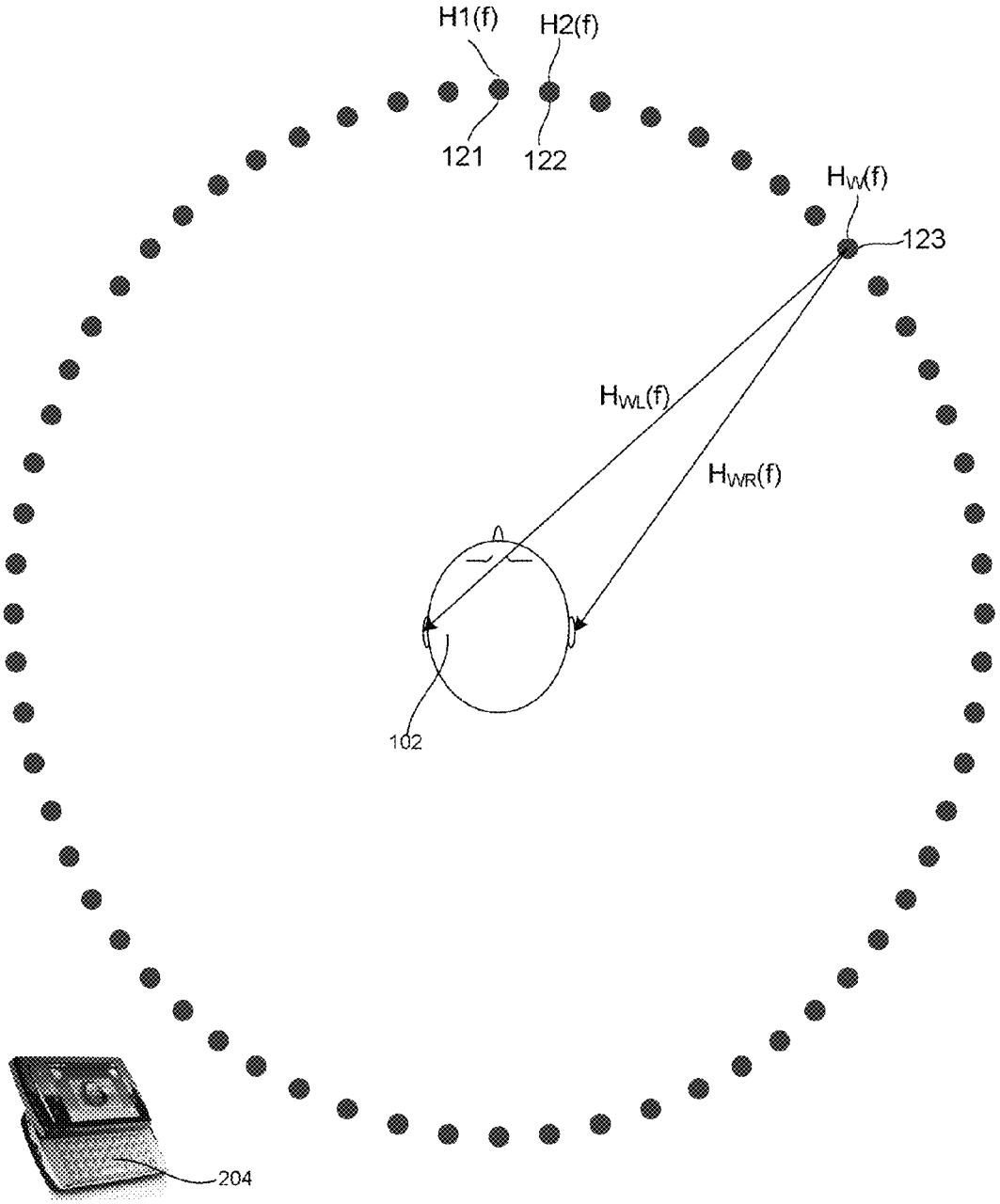

FIGS. 1A, 1B, and 1C illustrate the concepts described herein. FIG. 1A shows a user 102 listening to a sound 104 that is generated from a source 106. As shown, user 102's left ear 108-1 and right ear 108-2 may receive different portions of sound waves from source 106 for a number of reasons. For example, ears 108-1 and 108-2 may be at unequal distances from source 106, and, consequently, a wave front may arrive at ears 108 at different times. In another example, sound 104 arriving at right ear 108-2 may have traveled different paths than the corresponding sound at left ear 108-1 due to different spatial geometry of objects (e.g., the direction in which ear 108-2 points is different from that of ear 108-1, user 102's head obstructs ear 108-2, different walls facing each of ears 108, etc.). More specifically, for example, portions of sound 104 arriving at right ear 108-2 may be diffracting about head 102 before arriving at ear 108-2.

Assume that the acoustic transformations from source 106 to left ear 108-1 and right ear 108-2 are encapsulated in or summarized by head-related transfer functions (HRTFs) $G_L(f)$ and $G_R(f)$, respectively, where f denotes frequency. Then, assuming that sound 104 at source 106 is X(f), the sounds arriving at each of ears 108-1 and 108-2 can be expressed as $G_L(f)\cdot X(f)$ and $G_R(f)\cdot X(f)$, respectively.

FIG. 1B shows a pair of earphones 110-1 and 110-2 that are controlled by a user device 204 within a sound system. Assume that user device 204 causes earphones 110-1 and 110-2 to generate signals $H_L(f)\cdot X(f)$ and $H_R(f)\cdot X(f)$, respectively, where $H_L(f)$ and $H_R(f)$ are approximations of $G_L(f)$ and $G_R(f)$. By generating $H_L(f)\cdot X(f)$ and $H_R(f)\cdot X(f)$, user device 204 and earphones 110-1 and 110-2 may emulate sound source 106 and spatial transformation of sound 104. The more accurately $H_L(f)$ and $H_R(f)$ approximate $G_L(f)$ and $G_R(f)$, the more accurately user device 204 and earphones 110-1 and 110-2 may emulate sound 104 that is perceived at ears 108 via earphones 110.

To generate $H_L(f)\cdot X(f)$ and $H_R(f)\cdot X(f)$, the sound system needs stored, pre-computed HRTFs $H_L(f)$ and $H_R(f)$ (collectively referred to as H(f)). A sound system may pre-compute and store HRTFs for a sound source located in a 3-dimensional (3D) space through different techniques. For example, a sound system may numerically solve one or more boundary value problems, for example, via the finite element method (FEM).

In pre-computing HRTFs, a system may obtain an H(f) for each of directions or locations from which the sound source may produce sounds. Thus, for example, a system that is to emulate a moving sound source may compute an H(f) for each point, on the path of the sound source, at which the system provides a snapshot of the sounds. The computed HRTFs may be used later to emulate the sounds.

FIG. 1C illustrates storing HRTFs for a given source at different directions in 3D space. As shown, a source may be located at any of 64 circles around user 102. Each of the circles is separated from its neighbors by approximately 5.5 degrees and is associated with an HRTF. For example, circles 121, 122, and 123 are associated with H1(*f*), H2(*f*), and $H_W(f)$, respectively. As indicated above, each HRTF includes an HRTF for the left ear and an HRTF for the right ear of user 102. For example, FIG. 1C shows $H_W(f)$ as being composed of $H_{WL}(f)$ and $H_{WR}(f)$. With $H_{WL}(f)$ and $H_{WR}(f)$, user device 204 may produce X(f) $H_{WL}(f)$ and X(f) $H_{WR}(f)$, via left earphone 110-1 and right earphone 110-2, respectively, to emulate the sounds that would have been produced at circle 123.

In FIG. 1C, for user device 204 to emulate the sounds from a sound source at any of the 64 circles, user device 204 needs to store each of the HRTFs that are associated with the 64 circles. Since each HRTF includes a left-ear HRTF and a right-ear HRTF, and each of the right/left-ear HRTFs includes a set of numbers (e.g., a frequency response), user device 204 may need to store a large volume of data to represent all of the HRTFs.

As described below, an acoustic system or device (e.g., device 204) may implement intensity panning to estimate an HRTF. This allows the system to use fewer stored HRTFs, and therefore, reduce the amount of storage space needed for HRTFs. Depending on the implementation, the acoustic system may use additional techniques to reduce the number of stored HRTFs.

Figure 2:
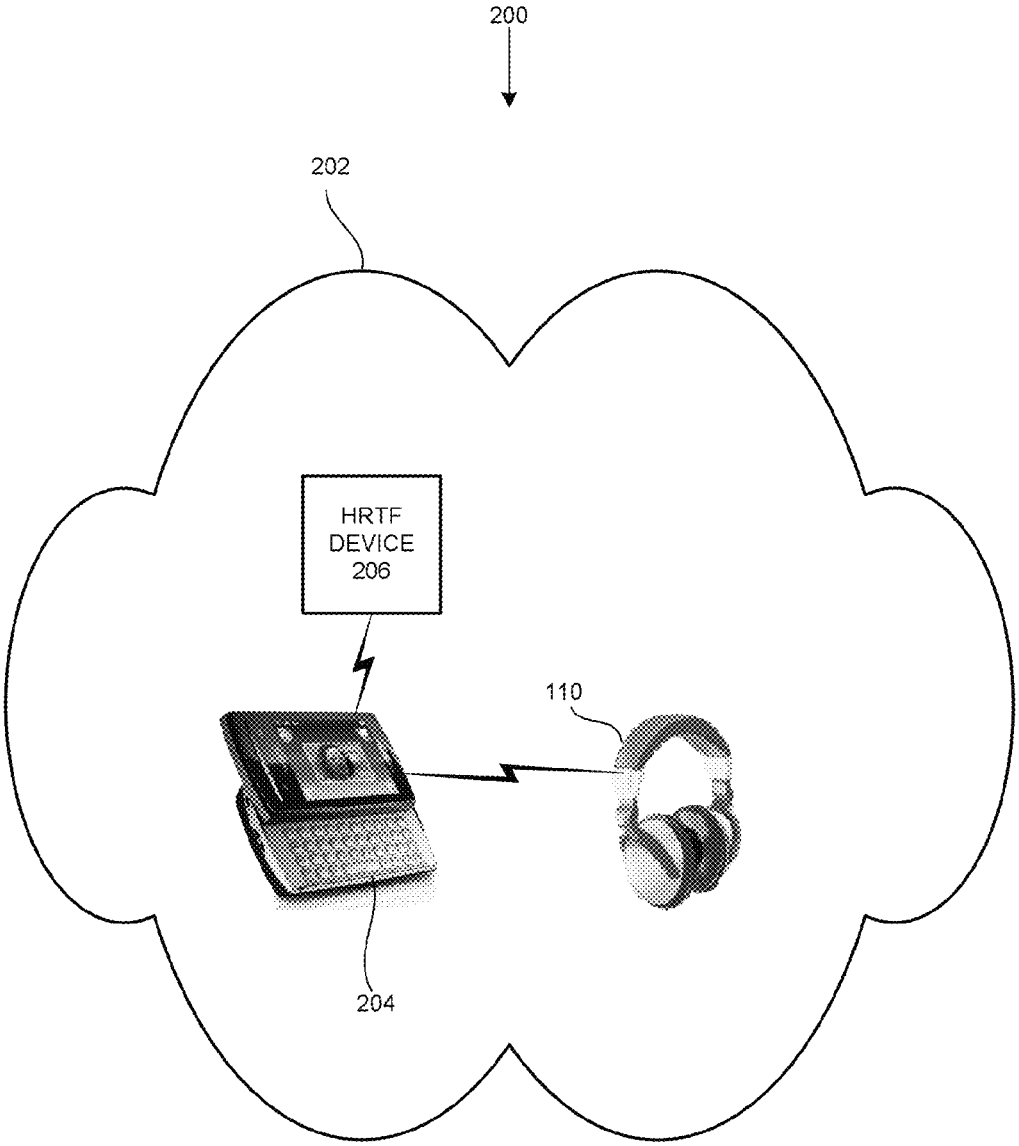
FIG. 2 shows an exemplary system in which the concepts described herein may be implemented.

FIG. 2 shows an exemplary system 200 in which concepts described herein may be implemented. As shown, system 200 may include network 202, user device 204, HRTF device 206, and earphones (or headphone) 110.

Network 202 may include a cellular network, a public switched telephone network (PSTN), a local area network (LAN), a wide area network (WAN), a wireless LAN, a metropolitan area network (MAN), personal area network (PAN), a Long Term Evolution (LTE) network, an intranet, the Internet, a satellite-based network, a fiber-optic network (e.g., passive optical networks (PONs)), an ad hoc network, any other network, or a combination of networks. Devices in system 200 may connect to network 202 via wireless, wired, or optical communication links. Network 202 may allow any of devices 204 through 208 to communicate with one another. Although network 202 may include other types of network elements, such as routers, bridges, switches, gateways, servers, etc., for simplicity, these devices are not illustrated in FIG. 2.

User device 204 may include any of the following devices to which earphones may be attached (e.g., via a headphone jack): a personal computer; a tablet computer; a cellular or mobile telephone; a smart phone; a laptop computer; a personal communications system (PCS) terminal that may combine a cellular telephone with data processing, facsimile, and/or data communications capabilities; a personal digital assistant (PDA) that includes a telephone; a gaming device or console; a peripheral (e.g., wireless headphone); a digital camera; or another type of computational or communication device.

Via user device 204, a user may place a telephone call, text message another user, send an email, etc. In addition, user device 204 may receive and store computed HRTFs from HRTF device 206. User device 204 may use the HTRFs to generate signals to drive earphones 110 to provide stereo sounds. In generating the signals, user device 204 may apply intensity panning, to be described below, based on HRTFs stored on user device 204.

HRTF device 206 may derive or generate HRTFs based on specific boundary conditions within a virtual acoustic environment. HRTF device 206 may send the HRTFs to user device 204.

When user device 204 receives HRTFs from HRTF device 206, user device 204 may store them in a database or another type of memory structure. In some configurations, when user device 204 receives a request to apply an HRTF (e.g., from a user or a program running on user device 204), user device 204 may select, from the database, particular HRTFs. User device 204 may apply the selected HRTFs to a sound source to generate an output signal. In other configurations, user device 204 may provide conventional audio signal processing (e.g., equalization) to generate the output signal. User device 204 may provide the output signal to earphones 110.

Earphones/headphones 110 may generate sound waves in response to the output signal received from user device 204. Earphones/headphones 110 may include different types of headphones, ear buds, in-ear speakers, in-concha speakers, etc. Earphones/headphones 110 may receive signals from user device 204 via a wireless communication link or a communication link over wire(s)/cable(s).

Depending on the implementation, system 200 may include additional, fewer, different, and/or a different arrangement of components than those illustrated in FIG. 2. For example, in one implementation, a separate device (e.g., an amplifier, a receiver-like device, etc.) may apply an HRTF generated from HRTF device 206 to an audio signal to generate an output signal. The device may send the output signal to earphones 110. In another implementation, system 200 may include a separate device for generating an audio signal to which an HRTF may be applied (e.g., a compact disc player, a digital video disc (DVD) player, a digital video recorder (DVR), a radio, a television, a set-top box, a computer, etc.). In yet another example, user device 204 and HRTF device 206 may be implemented as one device.

Figures 3A, 3B:
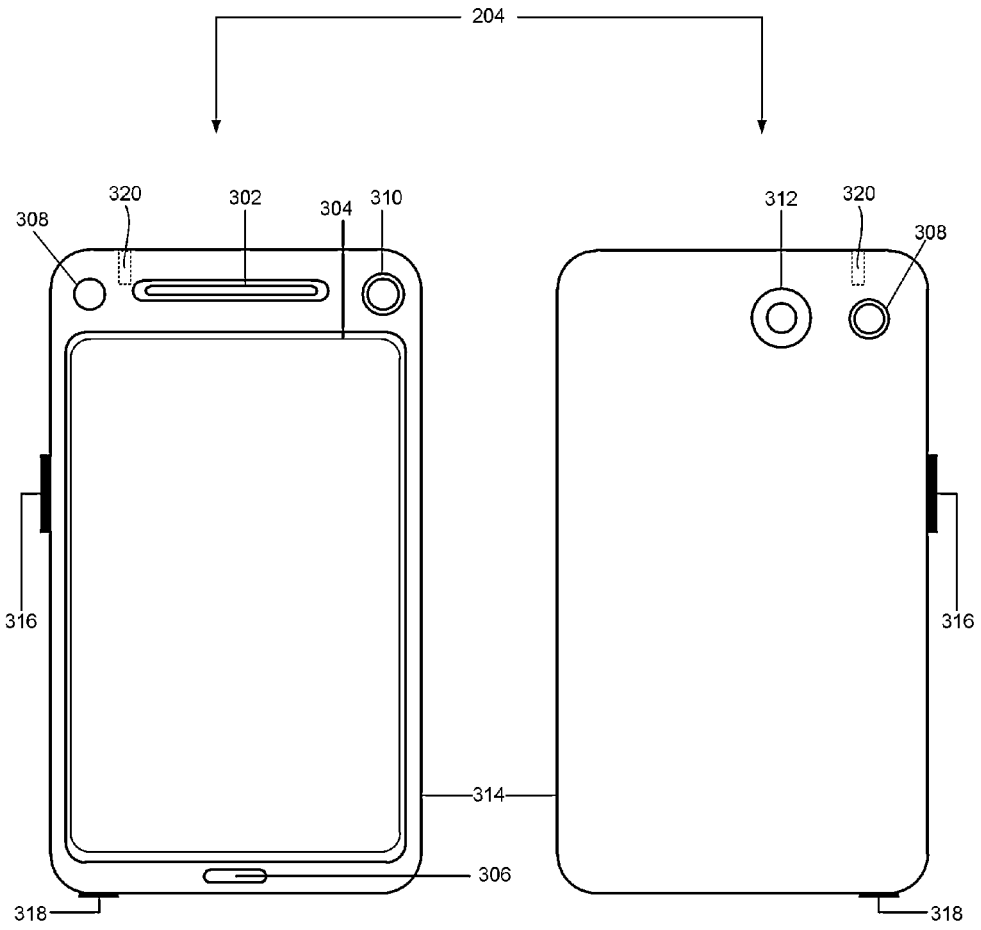
FIGS. 3A and 3B are front and rear views of an exemplary user device of FIG. 2.

FIGS. 3A and 3B are front and rear views, respectively, of user device 204 according to one implementation. In this implementation, user device 204 may take the form of a smart phone (e.g., a cellular phone). As shown in FIGS. 3A and 3B, user device 204 may include a speaker 302, display 304, microphone 306, sensors 308, front camera 310, rear camera 312, housing 314, volume control button 316, power port 318, and speaker jack 320. Depending on the implementation, user device 204 may include additional, fewer, different, or different arrangement of components than those illustrated in FIGS. 3A and 3B.

Speaker 302 may provide audible information to a user of user device 204. Display 304 may provide visual information to the user, such as an image of a caller, video images received via cameras 310/312 or a remote device, etc. In addition, display 304 may include a touch screen via which user device 204 receives user input. The touch screen may receive multi-touch input or single touch input.

Microphone 306 may receive audible information from the user and/or the surroundings. Sensors 308 may collect and provide, to user device 204, information (e.g., acoustic, infrared, etc.) that is used to aid the user in capturing images or to provide other types of information (e.g., a distance between user device 204 and a physical object).

Front camera 310 and rear camera 312 may enable a user to view, capture, store, and process images of a subject in/at front/back of user device 204. Front camera 310 may be separate from rear camera 312 that is located on the back of user device 204. Housing 314 may provide a casing for components of user device 204 and may protect the components from outside elements.

Volume control button 316 may permit user 102 to increase or decrease speaker volume. Power port 318 may allow power to be received by user device 204, either from an adapter (e.g., an alternating current (AC) to direct current (DC) converter) or from another device (e.g., computer). Speaker jack 320 may include a plug into which one may attach speaker wires (e.g., headphone wires), so that electric signals from user device 204 can drive the speakers (e.g., earphones 110), to which the speaker wires run from speaker jack 320

Figure 4:
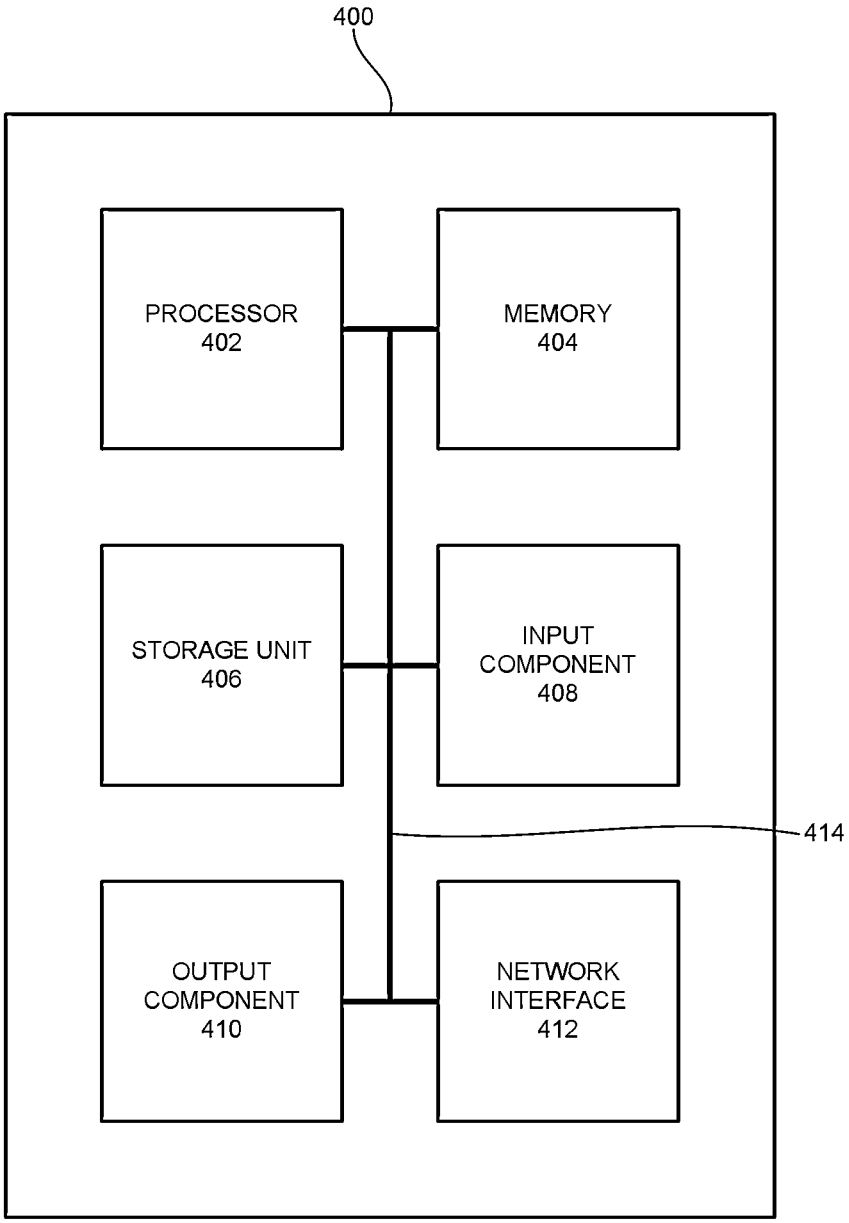
FIG. 4 is a block diagram of exemplary components of a network device of FIG. 2.

FIG. 4 is a block diagram of exemplary components of network device 400. Network device 400 may represent any of devices 204 through 208 in FIG. 2. As shown in FIG. 4, network device 400 may include a processor 402, memory 404, storage unit 406, input component 408, output component 410, network interface 412, and communication path 414.

Processor 402 may include a processor, a microprocessor, an Application Specific Integrated Circuit (ASIC), a Field Programmable Gate Array (FPGA), and/or other processing logic (e.g., audio/video processor) capable of processing information and/or controlling network device 400.

Memory 404 may include static memory, such as read only memory (ROM), and/or dynamic memory, such as random access memory (RAM), or onboard cache, for storing data and machine-readable instructions. Storage unit 406 may include storage devices, such as a floppy disk, CD ROM, CD read/write (R/W) disc, hard disk drive (HDD), flash memory, as well as other types of storage devices.

Input component 408 and output component 410 may include a display screen, a keyboard, a mouse, a speaker, a microphone, a Digital Video Disk (DVD) writer, a DVD reader, Universal Serial Bus (USB) port, and/or other types of components for converting physical events or phenomena to and/or from digital signals that pertain to network device 400.

Network interface 412 may include a transceiver that enables network device 400 to communicate with other devices and/or systems. For example, network interface 412 may communicate via a network, such as the Internet, a terrestrial wireless network (e.g., a WLAN), a cellular network, a satellite-based network, a wireless personal area network (WPAN), etc. Network interface 412 may include a modem, an Ethernet interface to a LAN, and/or an interface/connection for connecting network device 400 to other devices (e.g., a Bluetooth interface).

Communication path 414 may provide an interface through which components of network device 400 can communicate with one another.

In different implementations, network device 400 may include additional, fewer, or different components than the ones illustrated in FIG. 4. For example, network device 400 may include additional network interfaces, such as interfaces for receiving and sending data packets. In another example, network device 400 may include a tactile input device.

Figure 5:
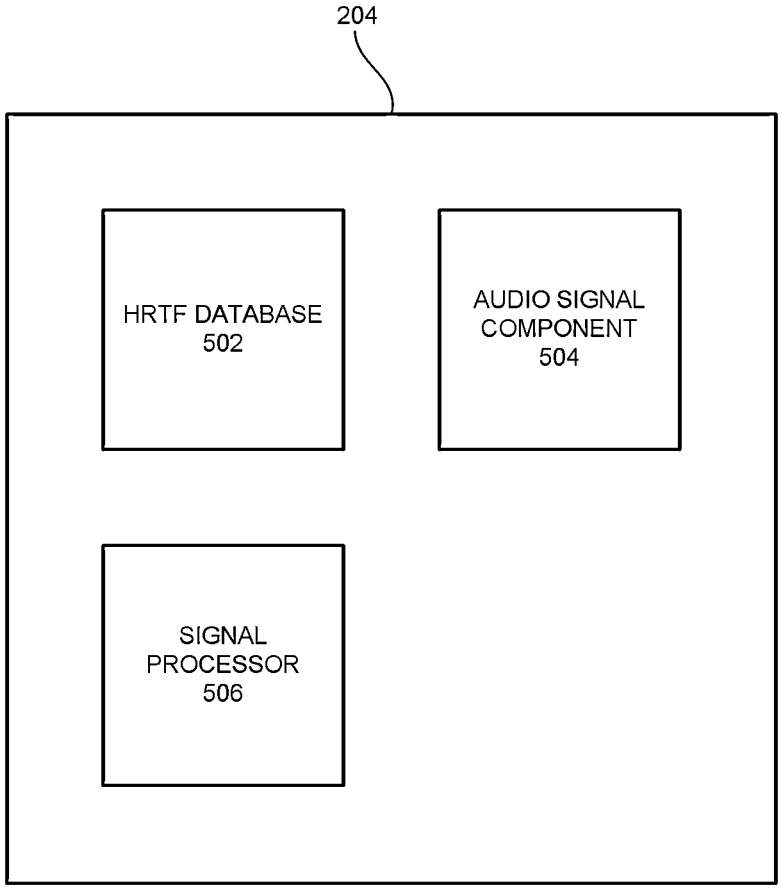
FIG. 5 is a functional block diagram the user device of FIG. 2.

FIG. 5 is a block diagram of exemplary functional components of user device 204. As shown, user device 204 may include an HRTF database 502, audio signal component 504, and signal processor 506. All or some of the components illustrated in FIG. 5 may be implemented by processor 402 executing instructions stored in memory 404 of user device 204.

Depending on the implementation, user device 204 may include additional, fewer, different, or a different arrangement of functional components than those illustrated in FIG. 5. For example, user device 204 may include an operating system, applications, device drivers, graphical user interface components, communication software, etc. In another example, depending on the implementation, audio signal component 504 and/or signal processor 506 may be part of a program or an application, such as a game, document editor/generator, utility program, multimedia program, video player, music player, or another type of application.

HRTF database 502 may receive HRTFs from another component or device (e.g., HRTF device 206) and store the HRTFs. Given a key (i.e., an identifier), HRTF database 502 may search its records for a corresponding HRTF and return all or portions of the HRTF (e.g., data in a range), a right-ear HRTF, a left-ear HRTF, etc.). In some implementations, HRTF database 502 may store HRTFs generated from user device 204 rather than HRTFs received from another device.

Audio signal component 504 may include an audio player, radio, etc. Audio signal component 504 may generate an audio signal (e.g., X(f)) and provide the signal to signal processor 506. In some configurations, audio signal component 504 may provide audio signals to which signal processor 506 may apply an HRTF and/or other types of signal processing. In other configurations, audio signal component 504 may provide audio signals to which signal processor 506 may apply only conventional signal processing.

Signal processor 506 may apply an HRTF or a portion of an HRTF retrieved from HRTF database 502 to an audio signal that is received from audio signal component 504 or from a remote device, to generate an output signal. In some configurations (e.g., selected via user input), signal processor 506 may also apply other types of signal processing (e.g., equalization), with or without an HRTF, to the audio signal. Signal processor 506 may provide the output signal to another device, for example, such as earphones 110.

Figure 6:
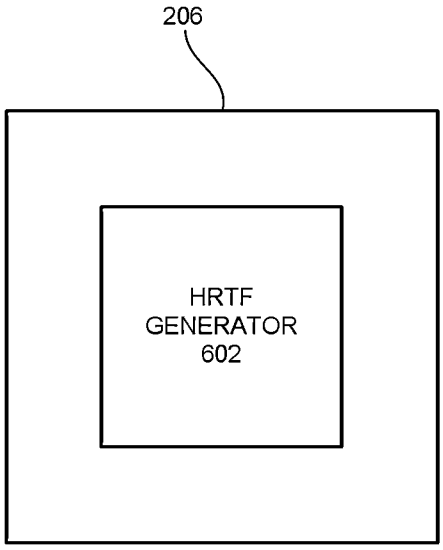
FIG. 6 is a functional block diagram of an exemplary head-related transfer function (HRTF) device of FIG. 2.

FIG. 6 is a functional block diagram of HRTF device 206. As shown, HRTF device 206 may include HRTF generator 602. In some implementation, HRTF generator 602 may be implemented by processor 402 executing instructions stored in memory 404 of user device 204. In other implementations, HRTF generator 602 may be implemented in hardware.

HRTF generator 602 may generate HRTFs, select HRTFs from the generated HRTFs, or obtain parameters that characterize the HRTFs based on information received from user device 204. In implementations or configurations in which HRTF generator 602 selects the HRTFs, HRTF generator 602 may include pre-computed HRTFs. HRTF generator 602 may use the received information (e.g., environment parameters) to select one or more of the pre-computed HRTFs. For example, HRTF generator 602 may receive information pertaining to the geometry of the acoustic environment in which a sound source virtually resides. Based on the information, HRTF generator 602 may select one or more of the pre-computed HRTFs.

In some configurations or implementations, HRTF generator 602 may compute the HRTFs or HRTF related parameters. In these implementations, HRTF generator 602 may apply, for example, a finite element method (FEM), finite difference method (FDM), finite volume method, and/or another numerical method, using 3D models to set boundary conditions.

Once HRTF generator 602 generates or selects HRTFs, HRTF generator 602 may send the generated/selected HRTFs (or parameters that characterize transfer functions (e.g., coefficients of rational functions)) or data that characterize a frequency response of the HRTFs to another device (e.g., user device 204).

Depending on the implementation, HRTF device 206 may include additional, fewer, different, or different arrangement of functional components than those illustrated in FIG. 6. For example, HRTF device 206 may include an operating system, applications, device drivers, graphical user interface components, databases (e.g., a database of HRTFs), communication software, etc.

Figure 7:
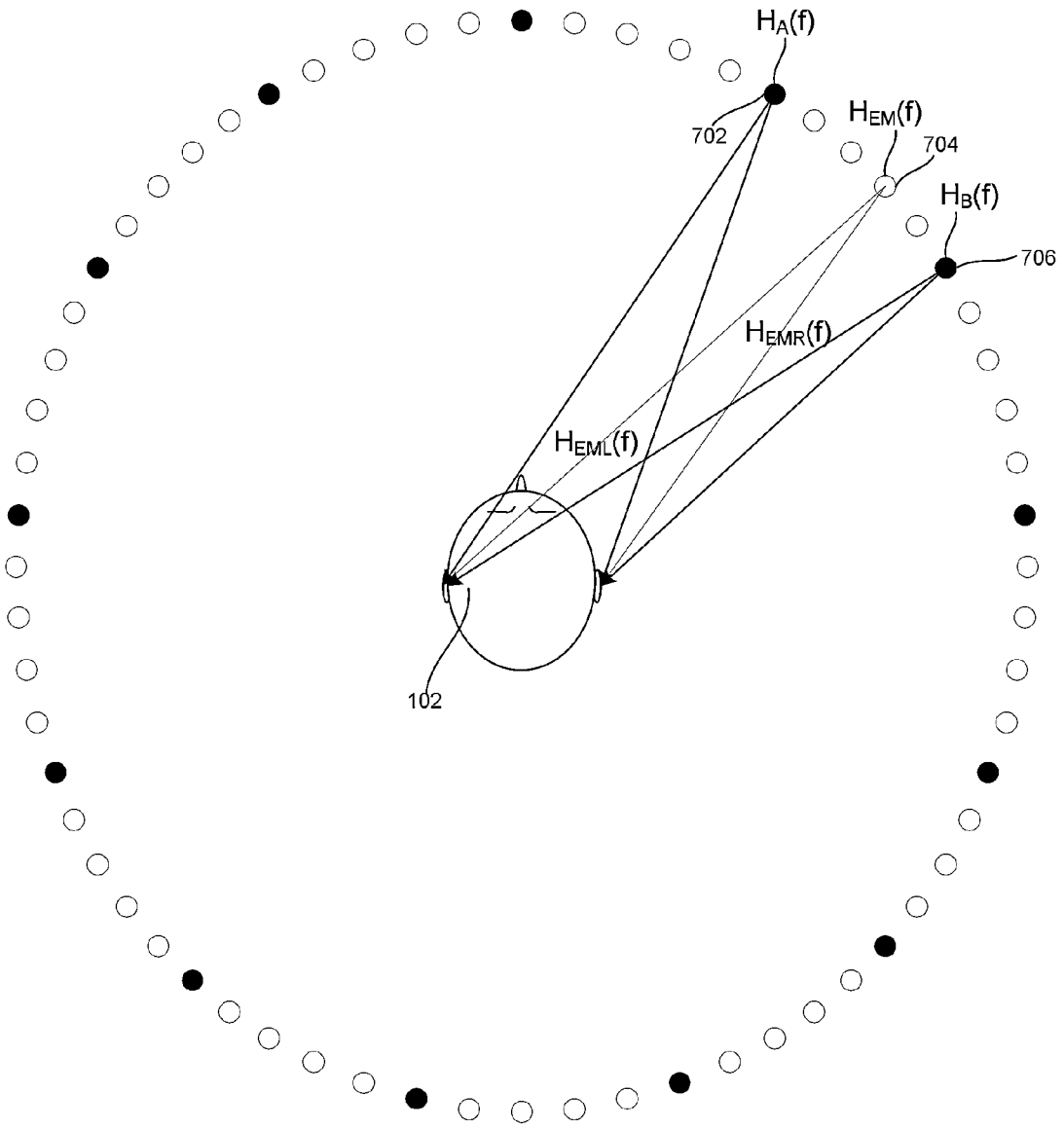
FIG. 7 illustrates intensity panning according to one implementation.

FIG. 7 illustrates intensity panning according to one implementation. Intensity panning may allow the amount of HRTF data that needs to be stored at user device 204 to be reduced. In FIG. 7, the filled/colored circles represent sound source positions for which user device 204 has stored HRTFs in HRTF database 402. The empty circles represent sound source positions for which user device 204 does not need to store HRTFs. Although the circles are shown as being approximately equidistant from the center of user 102's head or equally spaced apart, in an actual implementation, such need not be the case.

In this implementation, an HRTF for a sound source at a specific position is constructed by weighting HRTFs, associated with the neighboring, filled circles. For example, in FIG. 7, assume that user device 204 is to determine an HRTF $H_{EM}(f)$ or a value of the HRTF (e.g., value of the HRTF at a specific frequency) at circle 704. $H_{EM}(f)$ may be expressed as:

$$H_{EM}(f)=H_{EML}(f)\underline{l}+H_{EMR}(f)\underline{r} \quad (1)$$

In expression (1), $H_{EML}(f)$ and $H_{EMR}(f)$ represent the left-ear component and the right-ear component of $H_{EM}(f)$. $\underline{r}$ and $\underline{l}$ represent orthogonal unit basis vectors for the right- and left-ear vector space.

Similarly, one can express the HRTFs associated with neighboring circles 702 and 706 as follows:

$$H_A(f)=H_{AL}(f)\underline{l}+H_{AR}(f)\underline{r}, \quad (2) \text{ and}$$

$$H_B(f)=H_{BL}(f)\underline{l}+H_{BR}(f)\underline{r}. \quad (3)$$

In this implementation, the desired HRTF is obtained by "panning" the intensities of the neighboring HRTFs $H_A(f)$ and $H_B(f)$ as a function of their directions (i.e., angles) from the center of user 102's head. That is:

$$H_{EM}(f)\approx\alpha H_A(f)+\beta H_B(f). \quad (4)$$

Assume that θ represents the angle formed by point 702, the center of user 102's head, and point 704, and η represents the angle formed by point 704, the center of user 102's head, and point 706. Then, α and β may be pre-computed or selected, such that $\alpha/\beta=\theta/\eta$. α and β may be different for different circles/positions.

Using (1), (2), and (3), it is possible to rewrite expression (4) as:

$$H_{EM}(f) \approx \alpha(H_{AL}(f)\underline{l} + H_{AR}(f)\underline{r}) + \beta(H_{BL}(f)\underline{l} + H_{BR}(f)\underline{r}) = (\alpha H_{AL}(f) + \beta H_{BL1}(f))\underline{l} + (\alpha H_{AR}(f) + \beta H_{BR}(f))\underline{r} \quad (5)$$

Via the intensity panning, HRTFs for any of the empty circles in FIG. 7 (or any point between two of the circles) may be determined in accordance with expression (4) and/or (5). Accordingly, user device 204 does not need to store the values of HRTFs for the empty circles in FIG. 7. User device 204 needs to store only as many HRTFs as necessary to obtain the HRTF via intensity panning. In the above, although expression (4) and (5) show $H_{EM}(f)$ as a weighted sum of the $H_A(f)$ and $H_B(f)$, in other implementations, $H_{EM}(f)$ may be computed or determined via a more complex function of $H_A(f)$ and $H_B(f)$ (e.g., rational functions, polynomials, etc.).

Figure 8:
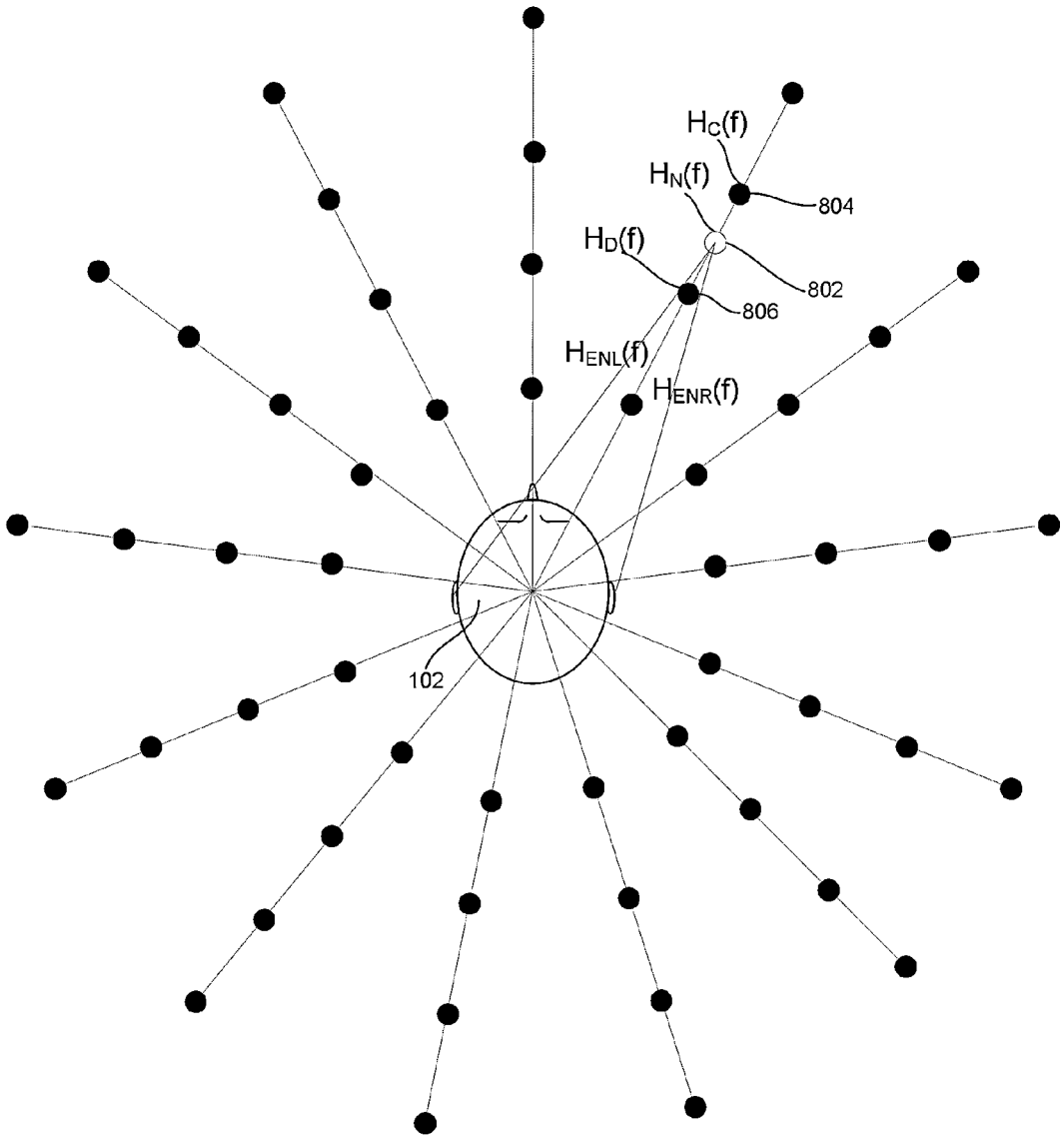
FIG. 8 illustrates intensity panning according to another implementation.

FIG. 8 illustrates intensity panning according to another implementation. As shown, the circles for which the HRTFs are stored in user device 204 are located at different distances from the center of user 102's head. In this implementation, an HRTF for a sound source at a specific position is constructed by using HRTFs, associated with the neighboring, filled circles.

For example, in FIG. 8, assume that user device 204 is to determine an HRTF $H_{EN}(f)$ or a value of the HRTF (e.g., value of the HRTF at a specific frequency) at circle 802. $H_{EN}(f)$ may be expressed as:

$$H_{EN}(f)=H_{ENL}(f)\underline{l}+H_{ENR}(f)\underline{r} \quad (6)$$

Analogous to expression (1), in expression (6), $H_{ENL}(f)$ and $H_{ENR}(f)$ represent the left-ear component and the right-ear component of $H_{EN}(f)$. Similarly, one can express the HRTFs for neighboring circles 804 and 806 as follows:

$$H_C(f)=H_{CL}(f)\underline{l}+H_{CR}(f)\underline{r}, \quad (7) \text{ and}$$

$$H_D(f)=H_{DL}(f)\underline{l}+H_{DR}(f)\underline{r}. \quad (8)$$

In this implementation, the desired HRTF is obtained by "panning" the intensities of the neighboring HRTFs as function of their distances at a given angle. That is:

$$H_{EN}(f)\approx F(H_C(f), H_D(f)). \quad (9)$$

In expression (9), F is a known function of $H_C(f)$, $H_D(f)$. Using (6), (7), and (8), it is possible to rewrite expression (9) as:

$$H_{EN}(f) \approx F(H_{AL}(f)\underline{l} + H_{AR}(f)\underline{r}, H_{BL}(f)\underline{l} + H_{BR}(f)\underline{r}) = \psi(H_{CL}(f), H_{DL}(f))\underline{l} + \chi(H_{CR}(f), H_{DR}(f))\underline{r} \quad (10)$$

In expression (10), ψ and χ are known functions. Via the intensity panning, HRTFs for any point between two of the filled circles may be determined in accordance with expression (9) and/or (10). Accordingly, user device 204 does not need to store the values of HRTFs for all possible positions of a sound source. User device 204 needs to store only as many HRTFs as needed for obtaining the HRTF. In contrast to expressions (1) through (5), expressions (6) through (10) may or may not describe linear functions.

Figure 9:
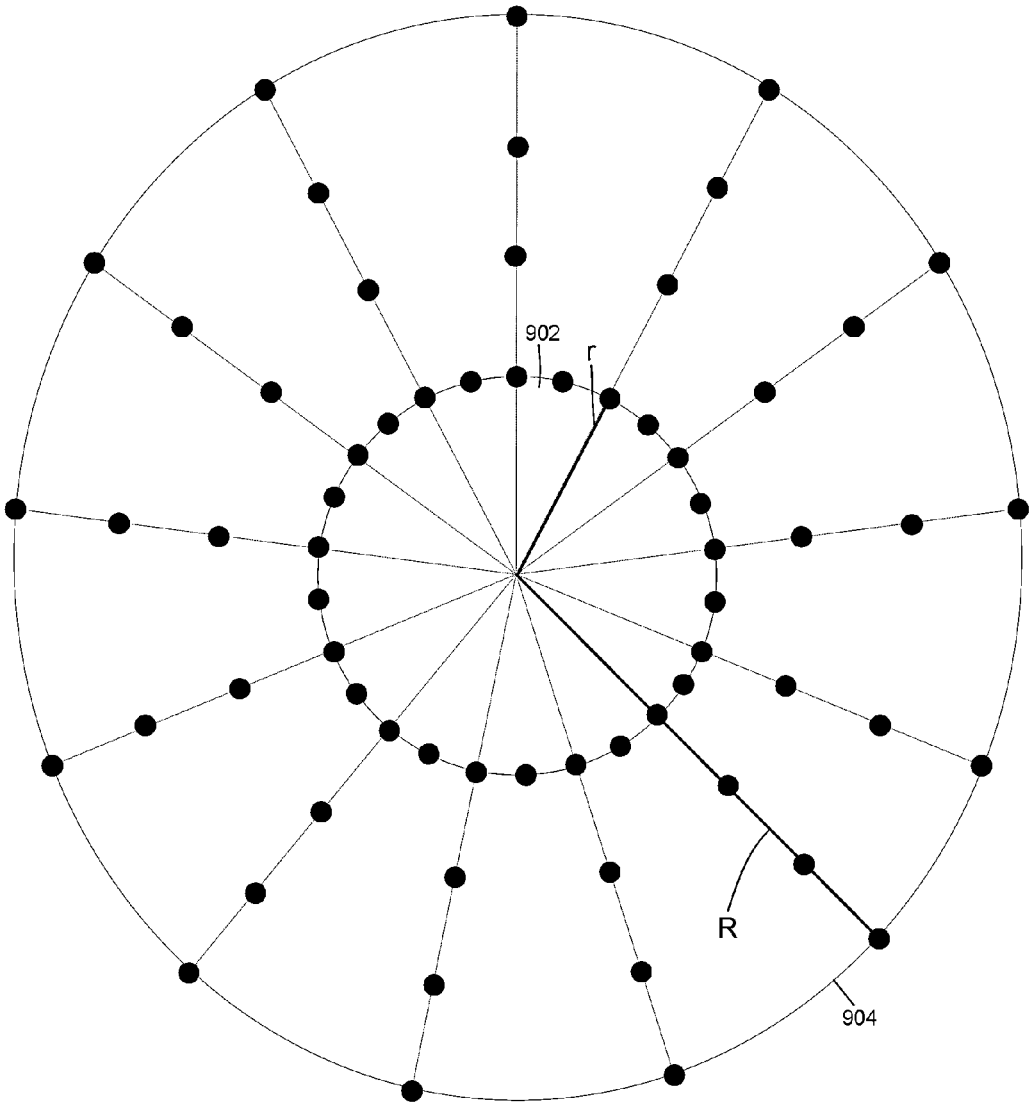
FIG. 9 illustrates regions, in the 3D space shown in FIG. 7, in which the number of HRTFs may or may not be reduced.

FIG. 9 illustrates regions, in the 3D space shown in FIG. 7 and FIG. 8, in which HRTFs may not be decreased. In FIG. 9, the 3D space shown in FIG. 7 and FIG. 8 are partitioned into region 902 and region 904. Regions 902 and 904 have approximate radii of r and R, respectively. In region 902, because user 102's head is large relative to the distance between user 102's head and any circle (i.e., a location for a sound source), intensity panning may not provide a good approximate HRTF. Accordingly, user device 204 may not reduce the number of HRTFs stored for region 902. For region 904, user device 204 may store HRTFs that may be used for intensity panning Outside of regions 902 and 904, user device 204 may store even fewer HRTFs, depending on the extent to which an HRTF for a given location may be approximated with other HRTFs.

In some implementations, user device 204 may store fewer HRTFs based on the symmetry of the acoustic environment. For example, in FIG. 7, assume that the circles to the right side of user 102's head are at locations symmetric to those of the circles to the left side of user 102's head. In such an instance, only HRTFs for the right side of user 102 head may need to be stored. If an HRTF to the right side o user 102's head is denoted by HR(f) and a mirror-image HRTF is denoted by HL(f), then, HR(f) and HL(f) can be expressed as:

$$HR(f)=HR_L(f)\underline{l}+HR_R(f)\underline{r}, \text{ and} \quad (11)$$

$$HL(f)=HL_L(f)\underline{l}+HL_R(f)\underline{r}. \quad (12)$$

Due to the symmetry, $HL_L(f)=HR_R(f)$ and $HL_R(f)=HR_L(f)$. In other words, HR(f) is a transpose of HL(f). This may be expressed as:

$$HL(f)=HR(f)^T. \quad (13)$$

Figure 10:
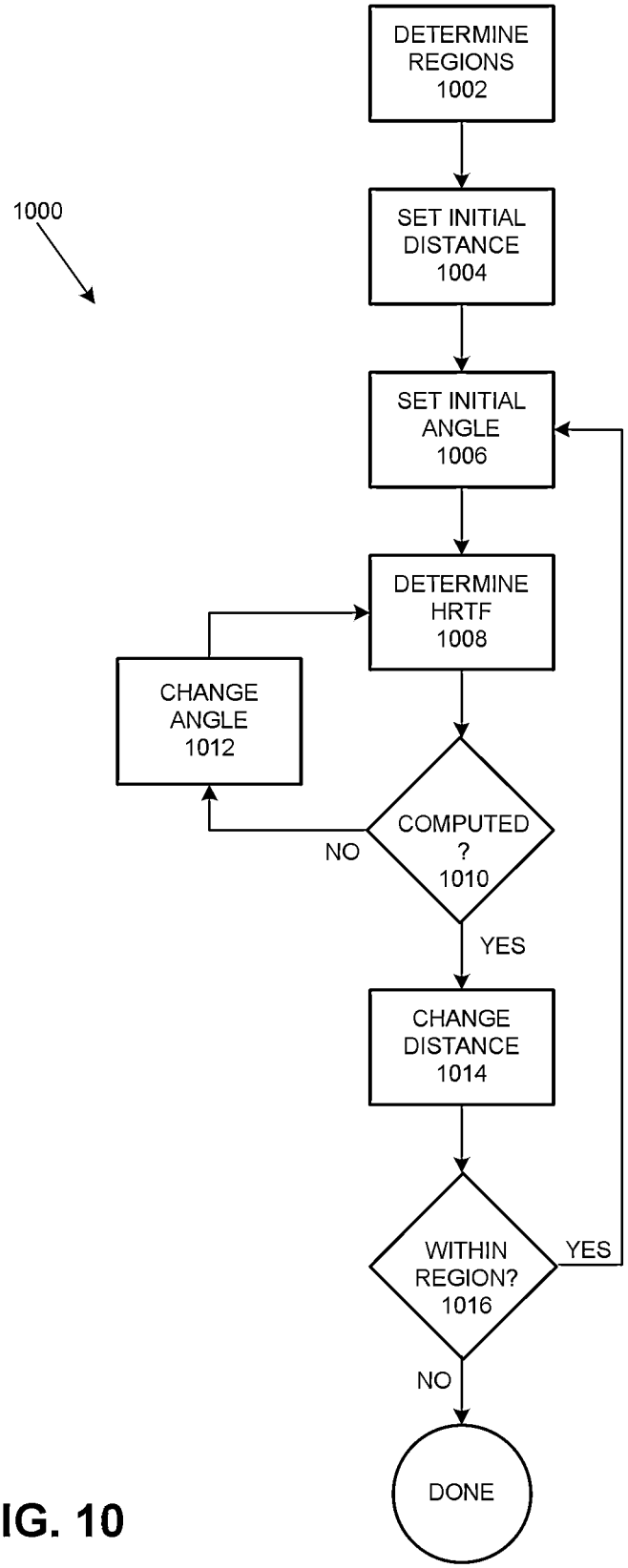
FIG. 10 is a flow diagram of an exemplary process for generating HRTFs for intensity panning.

FIG. 10 is a flow diagram of an exemplary process 1000 for generating HRTFs for intensity panning. In the following, process 1000 is described as being performed by HRTF device 206, although process 1000 may also be performed by user device 204. As shown, process 1000 may begin by determining a region R1, in 3D space, in which HRTFs may be used for intensity panning and a region R2 in which HRTFs may not be used for intensity panning (block 1002). In region R2, it may be necessary for HRTF device 206 or user device 204 to obtain HRTFs for each location for which user device 204 is to emulate sounds generated thereat, by a sound source.

HRTF device 206 may set an initial value of distance D (block 1004) and initial angle A (block 1006), at which HRTFs are to be computed, within region R1. At the current values of D and A, HRTF device 206 may determine HRTFs that are needed for intensity panning (block 1008). As discussed above, HRTF device 206 may use different techniques for computing the HRTFs (e.g., FEM).

HRTF device 206 may determine whether HRTFs for emulating a sound source from different angles (e.g., angles measured at the center of user 102's head relative to an axis) have been computed (block 1010). If the HRTFs have not been computed (block 1010: no), HRTF device 206 may increment the current angel A (for which the HRTF is to be computed) by a predetermined amount and proceed to block 1008, to compute/determine another HRTF. Otherwise (block 1010: yes), HRTF device 206 may modify the current distance for which HRTFs are to be computed (block 1014).

If the positions, for which the sound source is to be emulated, having distance D from user 102's head, are within region R1 for which intensity panning can be applied (block 1016: yes), HRTF device e204 may proceed to block 1006. Otherwise (block 1016: no), process 1000 may terminate.

Figure 11:
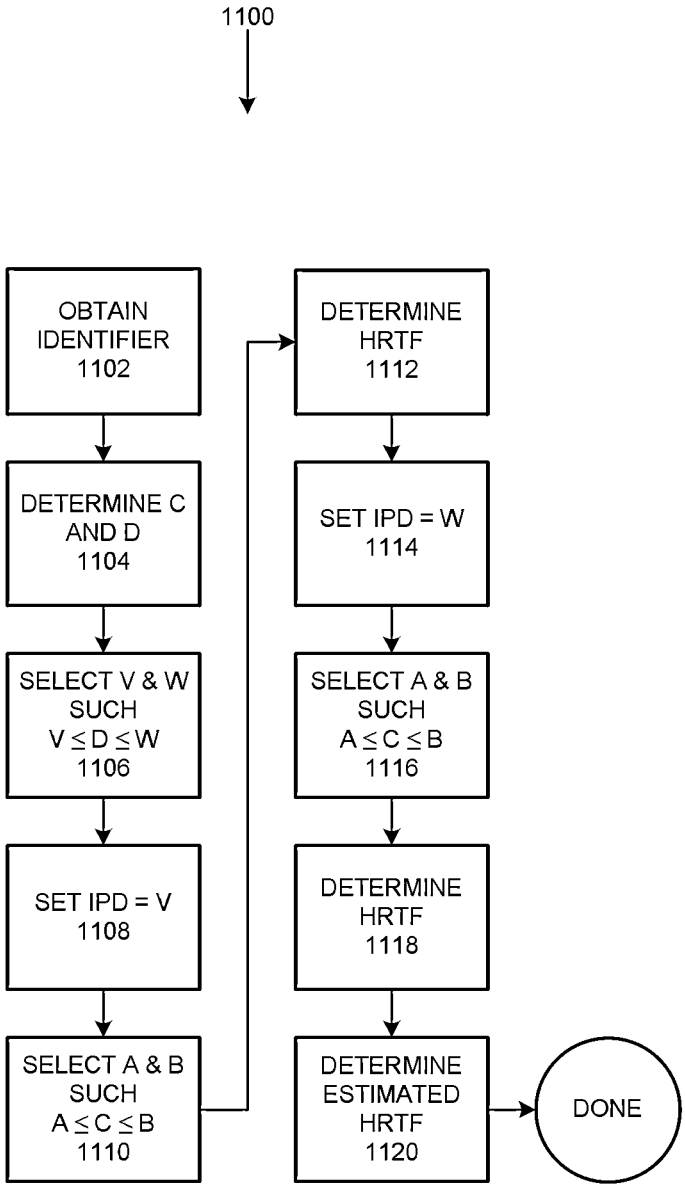
FIG. 11 is a flow diagram of an exemplary process for applying intensity panning based on HRTFs.

FIG. 11 is a flow diagram of an exemplary process 1100 for applying intensity panning based on the HRTFs that are generated from process 1000. Process 1100 may include obtaining an identifier for selecting a sound source or a particular location for which user device 204 is to emulate the sound source (block 1002). Depending on the implementation, user device 204 may receive the identifier from another device, from a program installed on user device 204, or from a user. Based on the identifier, user device 204 may determine an angle C and/or a distance D for which user device 206 may emulate the sound source (block 1104).

Once user device 204 has determined distance D, user device 204 may determine two distances V and W, such that V≤D≤W, where V and W are the distances, closest to D, for which HRTF database 502 includes a set of HRTFs that can be used for intensity panning (block 1106). Next, user device 204 may set an intensity panning distance (IPD) at V (block 1108).

Given the IPD=V, user device 204 may select two angles A and B such that A≤C≤B, where A and B are the angles, closest to C, for which HRTF database 502 includes two corresponding HRTFs (among the set/group of HRTFs mentioned above at block 1106) that can be used for intensity panning (block 1110). By applying one or more expressions similar to or equivalent to expressions (4) and (5), user device 204 may obtain the HRTF for the IPD=V (block 1112).

User device 204 may set the IPD=W (block 1114). Next, user device 204 may select two new angles A and B such that A≤C≤B. As at block 1110, A and B are the angles, closest to C, for which HRTF database 502 includes two corresponding HRTFs (among the set of HRTFs mentioned above at block 1106) that can be used for intensity panning (block 1116). By applying expressions similar to or equivalent to expressions (4) and (5), user device 204 may obtain the HRTF for the IPD=W (block 1118).

Once user device 204 has determined HRTFs at IPD=V and W (call them HRTFV and HRTFW), user device 204 may use the HRTFV and HRTFW to obtain an HRTF at distance D, via intensity panning in accordance with expressions (9) and (10) or other equivalent or similar expressions.

In some situations, V=W and user device 204 may simply use the result of block 112 as the HRTF for the source at distance D and angle A. Furthermore, in some situations, C=A (and C=B). In such situations, process 1100 may obtain the HRTF by a simple lookup of the HRTF for angle A in HRTF database 402, and there would be no need to perform intensity panning based on two HRTFs in HRTF database 402.

Process 1100 applies to generation of 3D sounds as a function of two variables (e.g., angle C and distance D), and may involve using up to four pairs of HRTFs (see blocks 1112, 1118, and 1120). In other implementations, a process that is similar to process 1100 may be implemented to generate 3D sounds as a function of three variables (e.g., distance D, azimuth angle C, and elevation E in the cylindrical coordinate system, radial distance P, azimuth angle C, and elevation angle G in the spherical coordinate system, etc.). In such implementations, rather than storing HRTFs for positions/locations as function of two variables as in FIG. 7, user device 204 may store HRTFs at positions in/locations as function of three variables in 3D space (not shown).

In such implementations, determining the overall estimate HRTF may involve using up to eight pairs of HRTFs (at corners of a cube-like volume in space enclosing the location at which the sound source is virtually located). For example, four pairs of HRTFs at one elevation may be used to generate the first estimate HRTF (e.g., via process 1100), and four pairs of HRTFs at another elevation may be used to generate the second estimate HRTF (e.g., via process 1100). Intensity panning the first and second estimate HRTFs produces the overall estimate HRTF.

After user device 204 or another device determines an estimated HRTF (e.g., see block 1120 in FIG. 11) based on stored HRTFs, user device 204 may then apply the resulting estimated HRTF to an audio signal, to produce an output signal. For example, assume that X(f) is the audio signal, Y(f) is the output signal, and $H_T(f)$ is the estimated HRTF, where $H_T(f)$ is determined in accordance with the following expression:

$$H_T(f)=\alpha H_A(f)+\beta H_B(f). \tag{11}$$

User device 204 then determines the output signal Y(f) according to:

$$Y(f)=X(f)\,H_T(f). \tag{12}$$

In some implementations, the stored HRTF may first be applied to an audio signal to obtain intermediate signals, and the intermediate signals may then be used to produce the output signal. That is, rather than determining Y(f) according to expression (12), use device 204 may rely on the following expression:

$$Y(f)=\alpha X(f)\,H_A(f)+\beta X(f)\,H_B(f) \tag{14}$$

That is, in these implementations, user device 204 may evaluate $\alpha X(f)\,H_A(f)$ and $\beta X(f)\,H_B(f)$ first and then sum the resulting evaluations to obtain Y(f). Expression (14) is obtained by substituting expression (11) into expression (12).

Conclusion

As described above, a system may drive multiple speakers in accordance with a head-related transfer function (HRTF) to generate realistic stereo sound. The HRTF may be determined by intensity panning pre-computed HRTFs. The intensity panning allows fewer HRTFs to be pre-computed for the system.

The foregoing description of implementations provides illustration, but is not intended to be exhaustive or to limit the implementations to the precise form disclosed. Modifications and variations are possible in light of the above teachings or may be acquired from practice of the teachings.

For example, in the above, user device 204 is described as applying an HRTF to an audio signal. In some implementations, user device 204 may off-load such computations to one or more remote devices. The one or more remote devices may then send the processed signal to user device 204 to be relayed to earphones 110, or, alternatively, send the processed signal directly to earphones 110.

In another example, when an acoustic environment for which user device 204 emulates stereo sounds is symmetric, user device 204 may further reduce the number of HRTFs that are stored. For example, in FIG. 7, assuming that the acoustic environment is symmetric with respect to a vertical axis running through the center of the user 102's head, only HRTFs on the one side of the vertical axis need be stored. If an HRTF which is on the other side of the vertical axis is needed, user device 204 may obtain the HRTF via the expression (13). Whether the number of stored HRTFs can be reduced may depend on the specific symmetry that is present in the acoustic environment (e.g., symmetry with respect to the center of user 102's head, a symmetry with respect to a plane, etc.).

In the above, while series of blocks have been described with regard to the exemplary processes, the order of the blocks may be modified in other implementations. In addition, non-dependent blocks may represent acts that can be performed in parallel to other blocks. Further, depending on the implementation of functional components, some of the blocks may be omitted from one or more processes.

It will be apparent that aspects described herein may be implemented in many different forms of software, firmware, and hardware in the implementations illustrated in the figures. The actual software code or specialized control hardware used to implement aspects does not limit the invention. Thus, the operation and behavior of the aspects were described without reference to the specific software code—it being understood that software and control hardware can be designed to implement the aspects based on the description herein.

It should be emphasized that the term "comprises/comprising" when used in this specification is taken to specify the presence of stated features, integers, steps or components but does not preclude the presence or addition of one or more other features, integers, steps, components, or groups thereof.

Further, certain portions of the implementations have been described as "logic" that performs one or more functions. This logic may include hardware, such as a processor, a microprocessor, an application specific integrated circuit, or a field programmable gate array, software, or a combination of hardware and software.

No element, act, or instruction used in the present application should be construed as critical or essential to the implementations described herein unless explicitly described as such. Also, as used herein, the article "a" is intended to include one or more items. Further, the phrase "based on" is intended to mean "based, at least in part, on" unless explicitly stated otherwise.

What is claimed is:

1. A system comprising a device, the device comprising:

memory configured to store a subset of a plurality of head-related transfer functions (HRTFs) for emulating stereo sound from a source in three-dimensional (3D) space, each of the HRTFs corresponding to a direction and a distance, as perceived by a user, of the stereo sound;

an output interface for receiving audio information from a processor and outputting signals corresponding to the audio information; and the processor configured to:

obtain a first direction and a first distance from which first stero sound is to be perceived to arrive, by the user;

determine whether the subset of the plurality of HRTFs includes a first HRTF corresponding to the first direction and the first distance, wherein the plurality of HRTFs includes the first HRTF;

select first two HRTFs, in the subset of the plurality of HRTFs, corresponding to one distance;

use the first two HRTFs in the subset of the plurality of HRTFs to obtain a first estimated HRTF when the subset of the purality of HRTFs does not include the first HRTF;

select second two HRTFs, in the subset of the plurality of HRTFs, corresponding to another distance;

use the second two HRTFs in the subset of the plurality of HRTFs to obtain a second estimated HRTF when the subset of the plurality of HRTFs does not include the first HRTF;

determine a third estimated HRTF of the first HRTF based on the first estimated HRTF and the second estimated HRTF; and apply the third estimated HRTF to an audio signal to generate the audio information, wherein the first distance is between the one distance and the other distance.

2. The system of claim 1, further comprising:

earphones configured to receive the signals and to generate right-ear sound and left-ear sound.

3. The system of claim 2, wherein when the earphones receive the signals, the earphones receive the signals over a wireless communication link.

4. The system of claim 2, wherein the earphones comprise one of:

headphones; ear buds; in-ear speakers; or in-concha speakers.

5. The system of claim 1, wherein the device includes one of:

a tablet computer; a mobile telephone; a personal digital assistant; or a gaming console.

6. The system of claim 1, further comprising:

a remote device configured to generate the subset of the plurality of HRTFs.

7. The system of claim 1, wherein the plurality of HRTFs includes HRTFs that are mirror images of the subset of the plurality of HRTFs.

8. The system of claim 1, wherein when the processor uses the first two HRTFs in the subset of the plurality of HRTFs to obtain the first estimated HRTF, the processor is configured to:

select two directions that are closest to the direction of the stereo sound and whose two corresponding HRTFs are included in the subset of the plurality of HRTFs stored in the memory;

retrieve the two corresponding HRTFs from the memory; and form a linear combination of the two retrieved HRTFs to obtain the first estimated HRTF.

9. The system of claim 8, wherein when the processor forms the linear combination of the two retrieved HRTFs, the processor is further configured to:

obtain a first coefficient and a second coefficient;

obtain a first product of the first coefficient and one of the two retrieved HRTFs;

obtain a second product of the second coefficient and other of the two retrieved HRTFs; and add the first product to the second product to obtain the first estimated HRTF.

10. The system of claim 1, wherein when the processor determines that the subset of the plurality of HRTFs includes the first HRTF, the processor is further configured to:

retrieve the first HRTF from the memory.

11. A method comprising:

storing a subset of a plurality of head-related transfer functions (HRTFs) for emulating stereo sound from a source in three-dimensional (3D) space, each of the HRTFs corresponding to a direction and a distance from which the stereo sound is perceived to arrive, by a user hearing the stereo sound;

obtaining a first direction and a first distance from which first stereo sound is to be perceived to arrive, by the user;

determining whether the subset of the plurality of HRTFs includes a first HRTF corresponding to the first direction and the first distance, wherein the plurality of HRTFs includes the first HRTF;

selecting first two HRTFs, in the subset of the plurality of HRTFs, corresponding to one distance;

using the first two HRTFs in the subset of the plurality of HRTFs to obtain a first estimated HRTF when the subset of the plurality of HRTFs does not include the first HRTF;

selecting second two HRTFs, in the subset of the plurality of HRTFs, corresponding to another distance;

using the second two HRTFs in the subset of the plurality of HRTFs to obtain a second estimated HRTF when the subset of the plurality of HRTFs does not include the first HRTF;

determining a third estimated HRTF of the first HRTF based on the first estimated HRTF and the second estimated HRTF; and applying the third estimated HRTF to an audio signal to generate output signals for driving headphones, wherein the first distance is between the one distance and the other distance.

12. The method of claim 11, further comprising:

sending the output signals for the headphones over wires connected to the headphones.

13. The method of claim 11, further comprising:

receiving the subset of the plurality of HRTFs from a remote device.

14. The method of claim 11, wherein the plurality of HRTFs includes HRTFs that are mirror images of the subset of the plurality of HRTFs.

15. The method of claim 11, wherein the obtaining first estimated HRTF includes:

calculating a linear combination of the first two HRTFs.

16. The method of claim 11, further comprising:

retrieving the first HRTF from a memory when the subset of the plurality of HRTFs includes the first HRTF.

17. The method of claim 11, further comprising:

obtaining a distance from which the first stereo sound is to be perceived to arrive by the user.

18. The method of claim 17, further comprising:

determining whether a location of the source, as determined by the first direction and the first distance, is within a region, in the 3D space, in which the first HRTF cannot be estimated by one or more HRTFs in the subset of the plurality of HRTFs; and retrieving an HRTF corresponding to the location of the source when the location of the source is determined to be within the region; and applying the retrieved HRTF to the audio signal to generate the output signals for the headphones.

19. A non-transitory computer-readable medium comprising computer-readable instruction for configuring one or more processors to:

store a subset of a plurality of head-related transfer functions (HRTFs) for emulating stereo sound from a source in three-dimensional (3D) space, each of the HRTFs corresponding to a distance and direction from which the stereo sound is perceived to arrive, by a user hearing the stereo sound;

obtain a first direction and a first distance from which first stereo sound is to be perceived to arrive, by the user;

determine whether the subset of the plurality of HRTFs includes a first HRTF corresponding to the first direction and the first distance, wherein the plurality of HRTFs includes the first HRTF;

select first two HRTFs, in the subset of the plurality of HRTFs, corresponding to one distance;

use the first two HRTFs in the subset of the plurality of HRTFs to obtain a first estimated HRTF when the subset of the plurality of HRTFs does not include the first HRTF;

select second two HRTFs, in the subset of the plurality of HRTFs, corresponding to another distance;

use the second two HRTFs in the subset of the plurality of HRTFs to obtain a second estimated HRTF when the subset of the plurality of HRTFs does not include the first HRTF;

determine a third estimated HRTF of the first HRTF based on the first estimated HRTF and the second estimated HRTF; and apply the third estimated HRTF to an audio signal to generate output signals for driving headphones, wherein the first distance is between the one distance and the other distance.

20. The non-transitory computer-readable medium of claim 19, further comprising computer-executable instructions for further configuring the processor to:

send the output signals for the headphones over a wireless communication link.

* * * * *